US005738425A

United States Patent [19]

Rosenberg et al.

[11] Patent Number: 5,738,425

[45] Date of Patent: Apr. 14, 1998

[54] ADJUSTABLE DRAWER ORGANIZER

[76] Inventors: Gayle Rosenberg, Harmon Cove Towers, Suite 4, Secaucus, N.J. 07094; Eli Pine, 370 River Rd., Apartment G, Nutley, N.J. 07110; Dale C. Gledhill, 31 N. Eaglewood Dr., Salt Lake City, Utah 84054

[21] Appl. No.: 689,554

[22] Filed: Aug. 9, 1996

[51] Int. Cl.[6] ..... A47B 88/20

[52] U.S. Cl. ..... 312/348.3; 312/205; 312/291; 220/8

[58] Field of Search ..... 312/348.3, 205, 312/291; 220/410, 408, 405, 23.83, 8; 206/514, 553, 214, 371, 557, 561, 814

[56] References Cited

U.S. PATENT DOCUMENTS

| | | | |
|---|---|---|---|
| D. 330,219 | 10/1992 | Carlson et al. . | |
| D. 353,905 | 12/1994 | Lin . | |
| 958,857 | 5/1910 | Dennis | 220/8 |
| 2,214,042 | 9/1940 | Burdick . | |
| 2,218,300 | 10/1940 | Schuster . | |
| 2,889,924 | 6/1959 | Paulucci | 312/205 X |
| 3,135,383 | 6/1964 | Bloch | 206/553 |
| 3,703,326 | 11/1972 | Riviers . | |
| 4,061,395 | 12/1977 | Boole . | |
| 4,288,011 | 9/1981 | Grossman | 312/205 X |
| 4,305,629 | 12/1981 | Friis . | |
| 4,412,709 | 11/1983 | Ishii | 312/291 |
| 4,909,406 | 3/1990 | Wu | 220/8 |
| 4,982,857 | 1/1991 | Sher | 220/8 X |
| 4,993,786 | 2/1991 | De Giulio . | |
| 5,016,772 | 5/1991 | Wilk | 220/8 |
| 5,031,769 | 7/1991 | Shea et al. . | |
| 5,102,208 | 4/1992 | Joynes et al. | 312/205 |
| 5,160,026 | 11/1992 | Marsh . | |
| 5,292,571 | 3/1994 | Quinn . | |
| 5,302,015 | 4/1994 | Du Vall . | |
| 5,385,230 | 1/1995 | Nygard et al. | 206/214 |
| 5,411,165 | 5/1995 | Ellis . | |
| 5,421,646 | 6/1995 | McNamara et al. | 312/205 |

*Primary Examiner*—Peter M. Cuomo
*Assistant Examiner*—Hanh V. Tran
*Attorney, Agent, or Firm*—Thorpe, North & Western, L.L.P.

[57] ABSTRACT

A versatile drawer organizer structure for segregating a plurality of items. The structure includes a main compartment and two adjustable side compartments located on each side of the main compartment. Each of the side compartments can slide toward the main compartment or away from the main compartment thus decreasing and increasing the size of the side compartments and decreasing and increasing the overall width of the structure so that the structure precisely fits within the inside width of the drawer. The overall width of the structure can be adjusted without cutting of the material making up the structure and without making any permanent alterations to the structure. Thus, the structure can be easily sized to precisely fit the inside width of a large number of different drawers and many other enclosed spaces.

4 Claims, 4 Drawing Sheets

ADJUSTABLE DRAWER ORGANIZER

BACKGROUND

1. The Field of the Invention.

This invention relates to devices used to sort, segregate, and organize various items within an enclosed space.

2. The Background Art.

Almost every home and business has cabinets, dressers, desks, or other similar type of furniture with drawers that pull out and can be used to hold various items. Such items may be cooking utensils and cutlery, articles of clothing, such as stockings, underwear, and so forth, writing implements, office supplies, and other similar items. Generally, without some type of organizer in the drawer, such items are merely thrown into the drawer (or some other enclosed space) and the user must take the time to rummage through the various items in the drawer to find one particular item.

Thus, there is a need for structures to organize drawers and other similar enclosures so that the different items can be segregated so that one particular item can be quickly and easily retrieved from the drawer. In order to segregate and organize items which are stored in drawers as well as other enclosures, various structures have been proposed.

One approach to organizing a drawer has been to place boxes of different sizes within the drawer. This approach provides one or more compartments within the drawer in which items can be segregated. Disadvantageously, merely placing boxes in the drawer is unsatisfactory since the boxes do not fit precisely within the drawer and slide around and leave unused drawer space.

Another approach has attempted to overcome the disadvantages of placing boxes in the drawer. This approach provides one or more box like structures, which may be independently formed or formed as a unitary structure, which are cut to fit precisely within the drawer. Disadvantageously, many users do not want to bother with cutting the box structure or have difficulty making accurate cuts which are necessary to provide a precise fit within the drawer or cuts which are cosmetically pleasing. Moreover, once the box structure is cut, the structure will likely not precisely fit into another drawer of different dimensions and likely cannot be altered to provide a different arrangement even in the same drawer.

In view of the above mentioned disadvantages, it would be an advance in the industry to provide a structure for organizing drawers and similar enclosed spaces which overcomes these and other drawbacks.

BRIEF SUMMARY AND OBJECTS OF THE INVENTION

In view of the above described state of the art, the present invention seeks to realize the following objects and advantages.

It is a primary object of the present invention to provide an organizing structure for drawers and other enclosed spaces which is efficient and easy to use.

It is also an object of the present invention to provide an organizing structure for drawers and other enclosed spaces which can be sized to precisely fit at least one dimension of the drawer so that space in the drawer is efficiently used but does so without requiring any cutting or permeant alterations of the structure.

It is a further object of the present invention to provide an organizing structure for drawers and other enclosed spaces which can be constructed in different configurations to suit different types of items and which can be moved from drawer-to-drawer as needed.

These and other objects and advantages of the invention will become more fully apparent from the description and claims which follow, or may be learned by the practice of the invention.

The present invention provides a versatile structure for segregating a plurality of items in an enclosed space, for example a drawer. The dimensions of the drawer are referred to herein as a width, a depth, and a height. The preferred embodiments of the present invention include a main compartment and two adjustable side compartments located on each side of the main compartment. It is preferred that the main compartment and the side compartments each be fabricated in a rectangular, including a square, shape but many shapes can be used within the scope of the present invention. Each of the side compartments can slide toward the main compartment or away from the main compartment thus decreasing and increasing the size of the side compartments and decreasing and increasing the overall width of the structure so that the structure precisely fits within the inside width of the drawer. The overall width of the structure can be adjusted without cutting of the material making up the structure and without making any permanent alterations to the structure. Thus, embodiments of the present invention can be easily sized to precisely fit the inside width of the drawer and many other enclosed spaces.

A means for guiding the movement of the side compartments is preferably provided to keep the side compartments in place as the user sets the width of the structure to precisely fit within the width of the drawer. Embodiments of the present invention can be provided with two adjustable side compartments or only one adjustable side compartment. It is also preferred that the main compartment include a plurality of individual compartments which can each be designated to hold a particular type of item.

BRIEF DESCRIPTION OF THE DRAWINGS

In order to better appreciate how the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Reference will now be made to the drawings wherein like structures will be provided with like reference designations.

Figure 1:
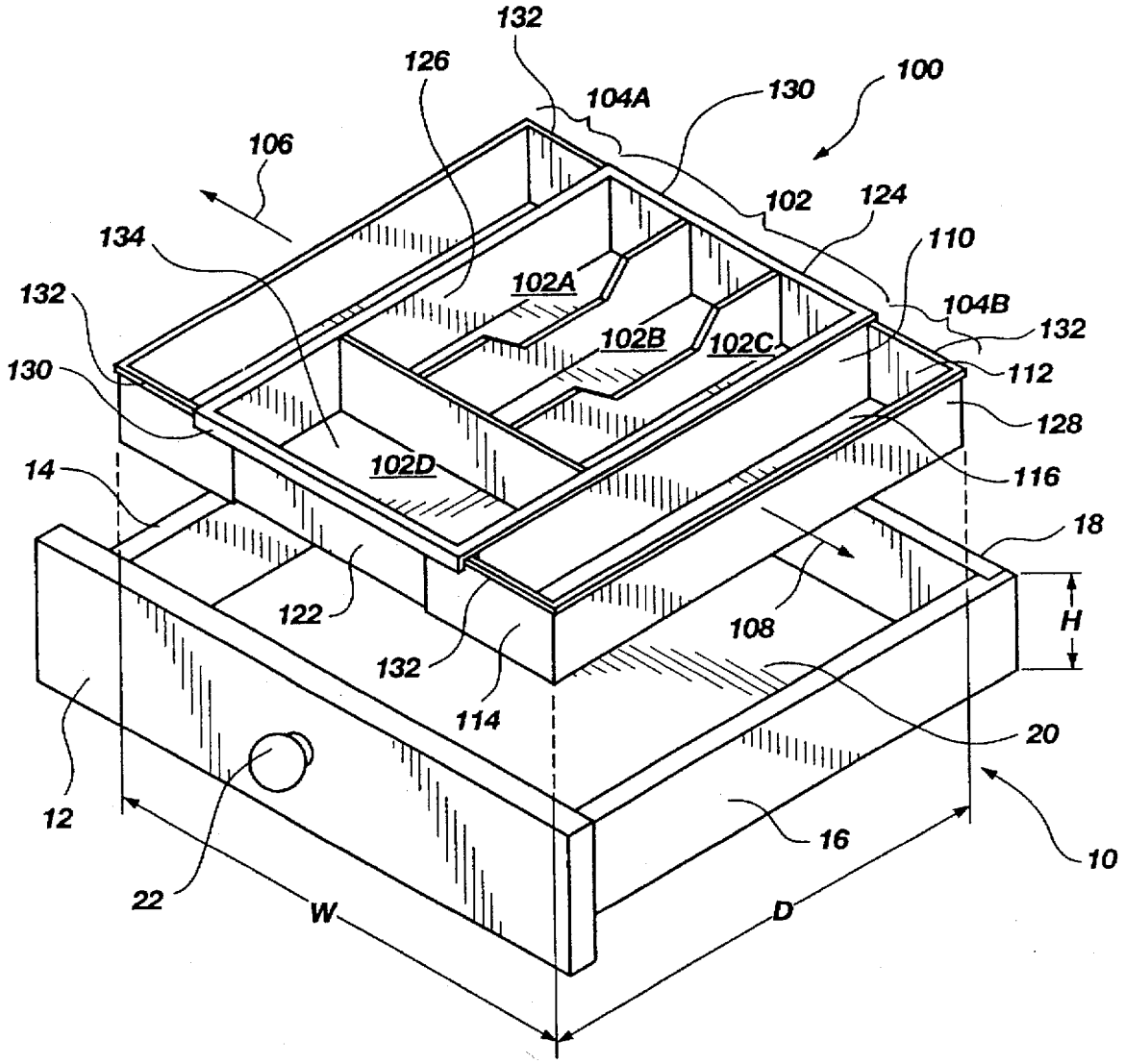
FIG. 1 is a perspective view of the first presently preferred embodiment of the present invention ready to be placed within a first drawer, the first drawer having a first width.

Reference will first be made to FIG. 1 which is a perspective view of a first adjustable drawer organizer in accordance with the present invention, generally designated at 100, ready to be placed within a drawer, the drawer being generally designated at 10. As will be fully discussed herein, the adjustable drawer organizer 100 is readily installed without requiring cutting of the adjustable drawer organizer 100 or making any permanent alterations thereof. Yet the adjustable drawer organizer 100 fits precisely within the drawer 10 so that the space inside the drawer 10 is used efficiently.

As can be seen in FIG. 1, the drawer 10 has an inside width W, an inside depth D, and an inside height H. The drawer 10 comprises a front wall 12 with a knob 22, a left side wall 14, a right side wall 16, a back wall 18, and a bottom 20. The drawer 10 is merely exemplary of the various enclosed spaces into which the embodiments of the present invention can be installed. The drawer 10 is typical of a kitchen drawer or a desk drawer. While a drawer, such as drawer 10, is an example of the type of enclosed space which can best benefit from the present invention, it will be appreciated, however, that other types of enclosed spaces, for example open shelves, enclosed shelves, storage boxes, dresser drawers, file cabinet drawers, and storage cabinets, can benefit from embodiments of the present invention.

The adjustable drawer organizer 100 includes a main compartment, indicated by the bracket 102, and two adjustable side compartments, a left adjustable side compartment indicated by the bracket 104A and a right adjustable side compartment indicated by the bracket 104B. As will be further compartments 104A&B can be adjusted so that the adjustable drawer organizer 100 can be fitted precisely within the inside width W of the drawer 10.

The main compartment 102 preferably includes a plurality of individual compartments 102A–D each of which can be configured to receive a particular type of item. For example, individual compartment 102A can be designated to receive a plurality of knives, compartment 102B can be designated to receive a plurality of forks, compartment 102C can be designated to receive a plurality of spoons, and compartment 102D can be designated to receive various kinds of kitchen cutlery. It will be appreciated that it is within the scope of the present invention to provide a main compartment 102 without any individual compartments or with individual compartments different than those illustrated herein and adapted to receive particular types of items.

The main compartment 102 includes a front wall 122, a rear wall 124, a bottom 134, and first and second sides 126 and 110, respectively. The main compartment 102, as well as all of the structures described in connection with the adjustable drawer organizer 100 can preferably be fabricated from one of a number of plastic materials well known in the industry using injection molding techniques, also well known to those skilled in the art. The embodiments of the present invention can also be fabricated from different materials using different techniques in accordance with the present invention.

The adjustable side compartments 104A&B in the adjustable drawer organizer 100 are preferably of identical construction in the illustrated preferred embodiment. Thus, the structure of the right adjustable side compartment 104B will be described with the understanding the left adjustable side compartment 104A substantially identical in structure and function. It is to be understood that it is within the scope of the present invention to include only one adjustable side compartment in accordance with the present invention and the embodiments of the present invention will still provide a precise fit within the inside width of the drawer as will be more fully explained shortly.

As shown best in FIG. 1 in connection with the right side adjustable compartment 104B, the right side and left side adjustable compartments 104A&B each include a side compartment front wall 114, a side compartment rear wall 112, a side compartment bottom 116, and a side compartment outer wall 128. It will be appreciated that it is within the scope of the present invention to omit main compartment bottom 134 and adjustable side compartment bottom 116 but that it is generally preferred to include such structures when the adjustable drawer organizer 100 is used in drawers such as drawer 10 and 24.

Since the side wall 110 functions as a wall of the adjustable side compartment 104B, there is no need for a separate fourth wall for the adjustable side compartment. As will now be appreciated, the open sided structure of the adjustable side compartments 104A&B advantageously allows the inside width of the side compartments 104A&B to vary from zero to the distance allowed by the front wall 114 and the rear wall 112.

Illustrated in FIG. 1 are arrows 106 and 108. The arrows 106 and 108 indicate that the left side adjustable compartment 104A and the right side adjustable compartment 104B can slide in a direction outward from the main compartment 102 to tightly fit against the inner surfaces of the left side wall 14 and the right side wall 16 of the drawer 10. In this way, the adjustable drawer organizer 100 is held in the proper place within the drawer 10 and the entire inside width of the drawer 10 is utilized by adjustable drawer organizer 100 to provide most efficient segregation of items. It is also preferred to provide that the depth of the adjustable drawer organizer 100 closely match that of the inside depth of the drawer 10. Even in the situations where the depth of the adjustable drawer organizer 100 is less than the inside depth D of the drawer 10, the friction fit obtained by setting the adjustable side compartments 104A&B holds the adjustable drawer organizer 100 in place in the drawer 10. Alternatively, a releasable adhesive or spacers can be provided to hold the adjustable drawer organizer 100 against the front wall 12 of the drawer.

As will be explained further shortly, the adjustable drawer organizer 100 preferably includes structures to assist with the sliding movement of the left adjustable side compartment 104A and the right adjustable side compartment 104B away from, and toward, the main compartment 102. Such a means for moving, also referred to as a means for guiding the movement of the side compartment, preferably keeps the side compartment outer wall 128 substantially parallel to the main compartment side wall 110. Thus, the side compartment front wall 114 is also kept parallel to the main compartment front wall 122. It is within the scope of the present invention to provide embodiments of the present invention, such as that represented in FIG. 1, wherein the structures are oriented at right angles and parallel to each. It is also within the scope of the present invention to utilize non-flat and non-straight components in the embodiments of the present invention. The inclusion of a means for guiding allows smooth adjustment of the size of the side compartments 104A&B. The means for guiding can also provide the function of holding size of the side compartment once it has been set by the user or this function can be provided by a separate structure.

The adjustable drawer organizer 100 of the present invention is very well suited for use in drawers such as are often found in residences. The inner dimensions of such drawers, and thus the dimensions of the adjustable drawer organizer 100 preferably fall within the following ranges: Depth in the range from about 12 inches to about 24 inches; Width in the range from about 6 inches to about 36 inches and height in the range from about 2 inches to about 18 inches. It will be appreciated that embodiments of the present invention can be utilized with drawers and other enclosed spaced which are larger or smaller than the specified range of dimensions.

Figure 2A:
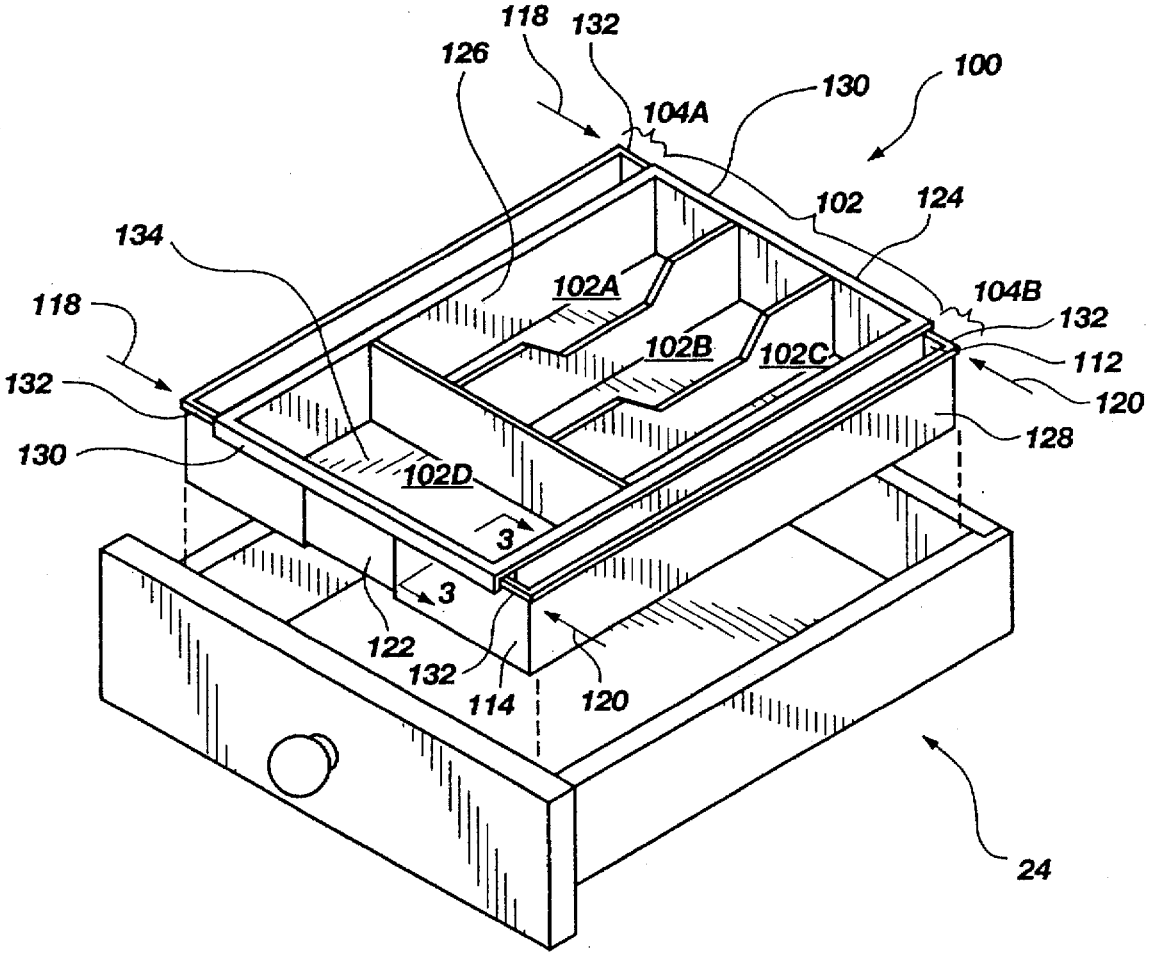
FIG. 2A is a perspective view of the first presently preferred embodiment of the present invention ready to be placed within a second drawer, the second drawer having a second width which is narrower than the first width of the first drawer.

Reference will next be made to FIG. 2A which is a perspective view of the first presently preferred embodiment of the present invention ready to be placed within a second drawer, the second drawer being generally indicated at 24. As can be seen in FIG. 2A, the second drawer has a width which is less than the width of the drawer 10. As represented by arrows 118 and 120, the adjustable side compartments 104A and 104B can be slide in a direction toward the main compartment 102 so that the entire width of the adjustable drawer organizer 100 is reduced to provide a precise fit within the inside width of the drawer 24.

Figure 2B:
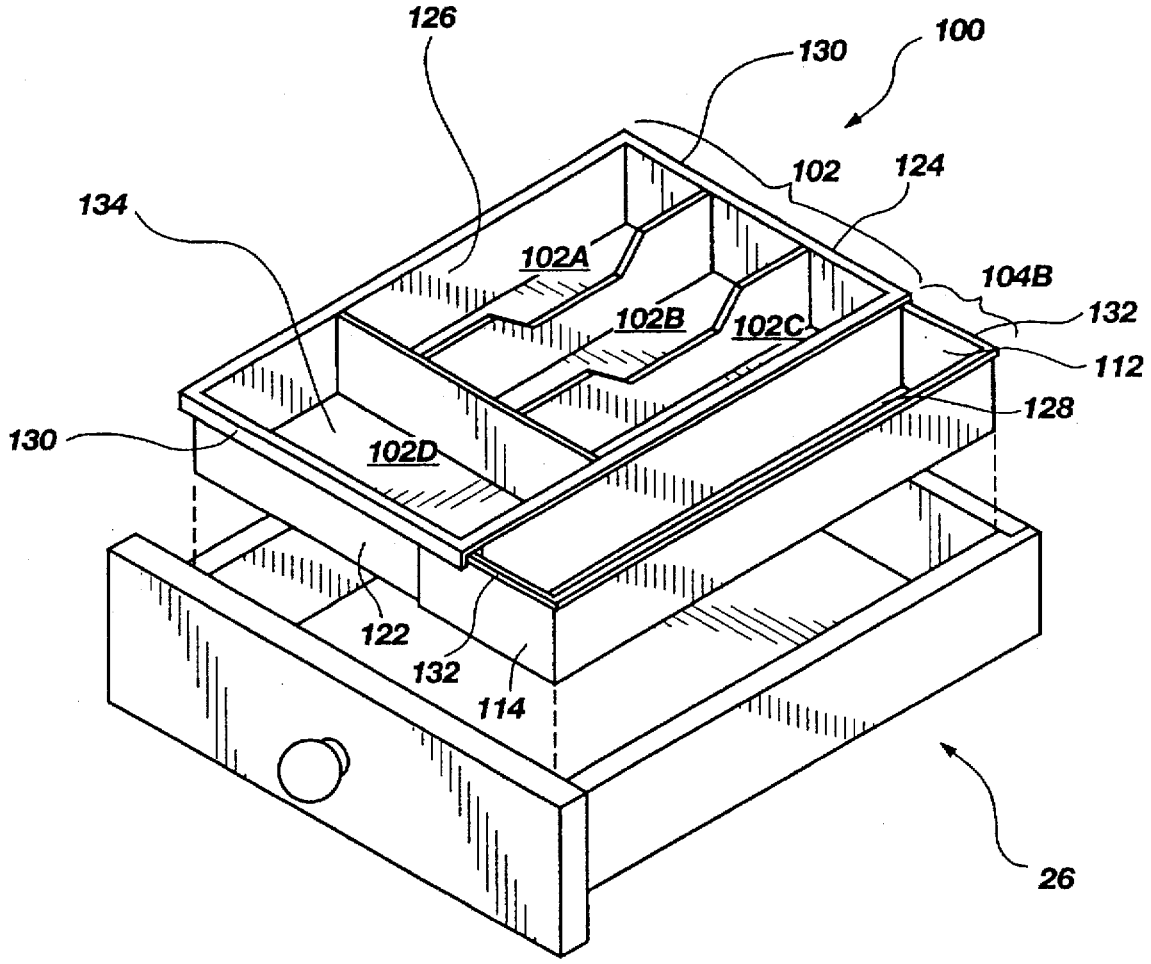
FIG. 2B a perspective view of the first presently preferred embodiment of the present invention ready to be placed within a third drawer.

Reference will next be made to FIG. 2B which is a perspective view of the adjustable drawer organizer 100 ready to be placed within a third drawer, generally indicated at 26. FIG. 2B shows the adjustable drawer organizer 100 with only adjustable side compartment 104B attached. The adjustable side compartment 104B is adjusted to provide a precise fit within the inside width of the drawer 26. It is to be understood that the size of the adjustable side compartments in relation to the main compartment can vary in accordance with the needs of the end user of the adjustable drawer organizer 100. Moreover, it is within the scope of the present invention to stack one or more adjustable drawer organizers 100 within an enclosed space for added segregated storage.

Figure 3:
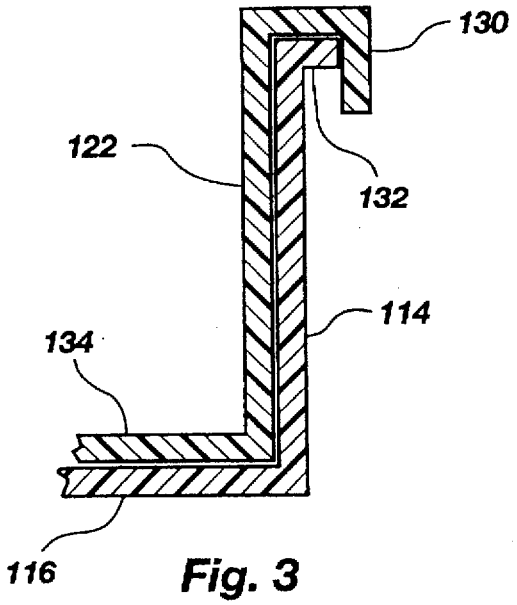
FIG. 3 is a cross sectional view of the first presently preferred embodiment of the present invention taken along line 3—3 of FIG. 2A.

Reference will next be made to FIG. 3 which is a cross sectional view of the adjustable drawer organizer 100 taken along line 3—3 of FIG. 2A. In FIG. 3 the main compartment bottom 134 and the side compartment bottom 116 can be seen. The cross section of FIG. 3 also shows the main compartment front wall 122 and the side compartment front wall 114. Provided on the upper end of the main compartment from wall 122 is a ledge 130 having a channel in the shape of an inverted "U." As represented in FIGS. 1, 2A, and 2B, the ledge preferably runs the width of the main compartment 102. As represented best in FIG. 3, on the upper end of the side compartment front wall 114 is a ridge 132 which fits within the channel of the ledge 130. The ridge 132 slides within the channel of the ledge 130 and guides the movement of the side compartment closer to, or away from, the main compartment. The structures represented in FIG. 3 are one preferred example of a means for guiding the movement of the side compartment.

It will also be appreciated that the structures represented in FIG. 3 can be fashioned to function as a means for holding the size of the side compartment once it has been set by the user. Inclusion of a means for holding in some embodiments of the present invention ensures that once a user sets the width of the adjustable drawer organizer 100 it remains precisely in place inside the drawer or other enclosed space. For example, the frictional engagement of the main compartment front wall 122 and the side compartment front wall 114 is an example of a means for holding. Alternatively, the means for holding the size of the side compartment can be provided by a separate structure, for example a locking structure or providing a releasable adhesive to hold the adjustable side compartments 104A&B in place. It will be appreciated that many different equivalent structures can perform the function of the means for guiding and the means for holding.

Figure 4:
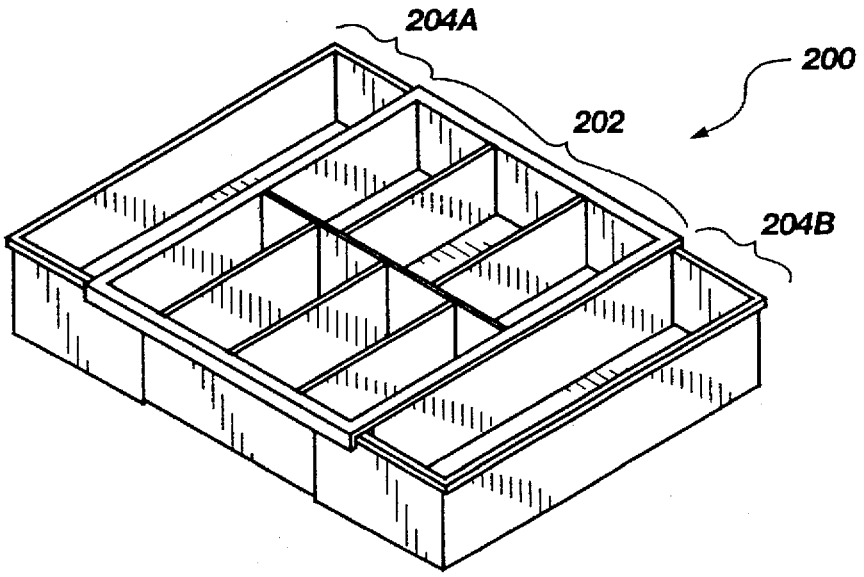
FIG. 4 is a perspective view of a second presently preferred embodiment of the present invention.

FIG. 4 is a perspective view of a second presently preferred embodiment of the present invention, generally indicated at 200. The embodiment of the present invention 200 represented in FIG. 4 is provided with a main compartment 202 and a left adjustable side compartment 204A and a right adjustable side compartment 204B. The main compartment 202 has been configured with a plurality of individual compartments each of which can be configured to receive a particular type of item. For example, the individual compartments can be designated to receive different articles of clothing, different writing implements and office supplies, or different hands tools and different power tools.

In view of the foregoing, it will be appreciated that the present invention provides a structure for organizing drawers and other enclosed spaces which is efficient and easy to use and which provides a structure for organizing drawers and other enclosed spaces which can be sized to precisely fit at least one dimension of the drawer so that space in the drawer is efficiently used but the structure does not require any cutting or permanent alterations of the structures. The present invention also provides a structure for organizing drawers and other enclosed spaces which can be constructed in alternative embodiments to suit different types of items and which can be moved from drawer-to-drawer.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States letters patent is:

1. A structure for segregating a plurality of items, the structure comprising:

a drawer having a drawer width, a drawer depth, a drawer height, and a drawer bottom;

a main compartment disposed on the drawer bottom, the main compartment having a front side, a back side, a first side, a second side, and a main width, the second side oriented in the same direction as the first side, and the front side oriented substantially parallel to the back side, the main compartment having a plurality of individual compartments;

a first side compartment disposed on the drawer bottom, the first side compartment positioned adjacent to the first side of the main compartment and having a first width and a first depth, the first side compartment having a front wall and a back wall and one side wall;

a first channel formed in a ledge along the front side of the main compartment;

a first ridge formed along the front wall of the first side compartment, the first ridge being positioned in sliding engagement with the first channel and at least partially surrounded by the first channel such that the ridge is covered by the channel and such that the distance between the first side of the main compartment and the side wall of the first side compartment is varied as the first ridge slides within the first channel such that the first width of the first side compartment is changed, but remains fixed unless selectively changed, and such that the combined first width and main width together substantially match the drawer width of the drawer such that the entire drawer width of the drawer is substantially occupied by at least the main compartment and the first side compartment so that the drawer is efficiently used.

2. A structure for segregating a plurality of items as defined in claim 1 further comprising:

a second side compartment disposed on the drawer bottom, the second side compartment positioned adjacent to the second side of the main compartment and having a second width and a second depth, the second side compartment having a front wall and a back wall and one side wall;

a second channel formed in a ledge along the back side of the main compartment;

a second ridge formed along the back wall of the second side compartment, the second ridge being positioned in sliding engagement with the second channel such that the distance between the second side of the main compartment and the side wall of the second side compartment is varied as the second ridge slides within the second channel such that the second width of the second side compartment is changed and such that the combined first width, second width, and main width together substantially match the drawer width of the drawer such that the entire drawer width of the drawer is substantially occupied by at least the main compartment, the first side compartment, and the second side compartment so that the drawer is efficiently used.

3. A structure for segregating a plurality of items as defined in claim 1 wherein the main compartment comprises: a compartment for holding knives; a compartment for holding forks, and a compartment for holding spoons.

4. A structure for segregating a plurality of items as defined in claim 1 wherein the first side compartment comprises a single unitary compartment.

* * * * *